US005258592A

United States Patent [19]

Nishikawa et al.

[11] Patent Number: 5,258,592

[45] Date of Patent: Nov. 2, 1993

[54] WATERPROOF SWITCH APPARATUS FOR ELECTRONIC DEVICE

[75] Inventors: Kenichi Nishikawa; Takahiro Hayashi; Yoshimasa Kawabata, all of Yokohama, Japan

[73] Assignee: Matsushita Electric Industrial Co., Ltd., Osaka, Japan

[21] Appl. No.: 873,823

[22] Filed: Apr. 27, 1992

[30] Foreign Application Priority Data

May 24, 1991 [JP] Japan ..... 3-120487

[51] Int. Cl.[5] ..... H01H 13/06

[52] U.S. Cl. ..... 200/302.2

[58] Field of Search ..... 200/302.2

[56] References Cited

U.S. PATENT DOCUMENTS

| | | | |
|---|---|---|---|
| 3,737,605 | 6/1973 | Tobey et al. | 200/302.2 |
| 3,789,176 | 1/1974 | Pick | 200/302.2 |
| 4,427,006 | 1/1984 | Nottke | 200/302.2 X |
| 4,471,189 | 9/1984 | Bacon et al. | 200/302.2 X |
| 4,845,325 | 7/1989 | Burchett et al. | 200/302.2 |
| 4,897,516 | 1/1990 | Wakatsuki | 200/302.2 |

FOREIGN PATENT DOCUMENTS

| | | | |
|---|---|---|---|
| 0221030 | 5/1987 | European Pat. Off. . | |
| 63-12509 | 4/1988 | Japan . | |
| 1218480 | 1/1971 | United Kingdom | 200/302.2 |
| 1309459 | 3/1973 | United Kingdom . | |
| 2025852 | 1/1980 | United Kingdom . | |
| 2165696 | 4/1986 | United Kingdom | 200/302.2 |

OTHER PUBLICATIONS

Research Disclosure, "Push Button Switch" Jan. 1991, p. 60.

*Primary Examiner*—Renee S. Luebke

*Attorney, Agent, or Firm*—Stevens, Davis, Miller & Mosher

[57] ABSTRACT

A waterproof switch apparatus for an electronic device comprises at least one push-button for switching, a sheet-like water sealing member groove-engaged with the shaft portion of the push-button, and a holding member for holding the water sealing member by pressing the outer peripheral portion of the water sealing member against the device body. An excellent waterproof feature and a thin shape of the waterproof switch apparatus can be obtained.

8 Claims, 3 Drawing Sheets

WATERPROOF SWITCH APPARATUS FOR ELECTRONIC DEVICE

BACKGROUND OF THE INVENTION

The present invention relates to a waterproof switch apparatus for an electronic device.

FIG. 4 shows a structure of a conventional waterproof switch for an electronic device. In FIG. 4, numeral 1 denotes a push-button, which is mounted on a device body 4 with its head portion 1*a* borne by a return spring 2 and with its shaft portion 1*b* fitted with a E-ring 3. Numeral 5 denotes a waterproof ring, which is fitted in an annular groove 1*c* formed on the peripheral . surface of the shaft portion 1*b* of the push-button 1 and in close contact with the device body 4, thereby preventing water from intruding into the inside of the device body 4. Numeral 6 denotes a printed circuit board, and numeral 7 a diaphragm mounted on the printed circuit board 6 at a position opposite to the tip portion of the shaft portion 1*b* of the push-button 1.

The function of the above-mentioned conventional push-button switch is described below. In FIG. 4, when the push-button 1 is pushed down, the tip portion of the shaft portion 1*a* pushes the diaphragm 7, thereby closing a contact mounted on the printed circuit board 6 for sending electric power. When the pushing force against the push-button 1 is released, the push-button returns to its original position by the help of the elastic force of the return spring 2, thereby also returning the diaphragm to its original position and opening the contact.

Since a waterproof rubber ring 5 is provided between the shaft portion 1*b* of the push-button 1 and the device body 4, intrusion of water into the inside of the device body 4 is prevented.

Thus, in the above-mentioned conventional waterproof switch for an electronic device, water intrusion into the inside of the device body can be also prevented by use of a waterproof rubber ring.

The above-mentioned conventional waterproof switch includes, however, a problem that there is required a space for permitting the plate spring 2 to deform and in addition, a space for permitting the waterproof rubber ring 5 to move in close contact with the device body 4, and as a result, the switch as a whole and the device body 4 as well become thick.

SUMMARY OF THE INVENTION

The object of the present invention is to provide an excellent waterproof switch apparatus for an electronic device which solves the above-mentioned problem of a prior art and has a thin thickness of the switch as a whole.

For achieving this object, a waterproof switch apparatus according to the present invention comprises a flat elastic sealing member with its inner periphery portion engaged and closely contacted with the shaft portion of the push-button and with its outer periphery portion closely contacted to the device body by use of a holding means.

In consequence, since, according to the present invention, the water sealing member has a function of a return spring used in the prior art, no special space for a return spring is required, thereby providing an advantage that the thickness of the switch apparatus as a whole can be made thin.

DESCRIPTION OF THE INVENTION

Figure 1:
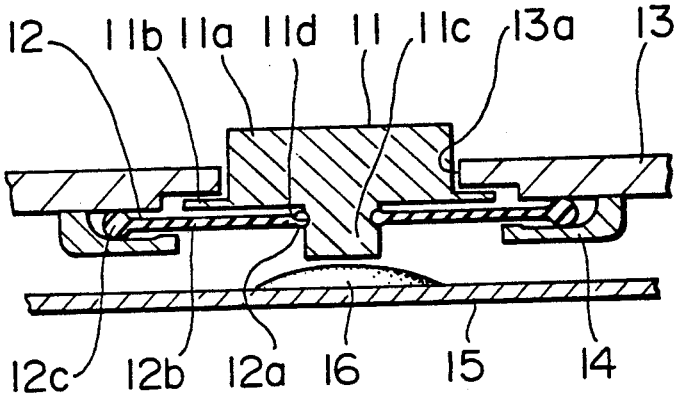
FIG. 1 is an elevational sectional view of a waterproof switch apparatus for an electronic device according to a first embodiment of the present invention.
Figure 4:
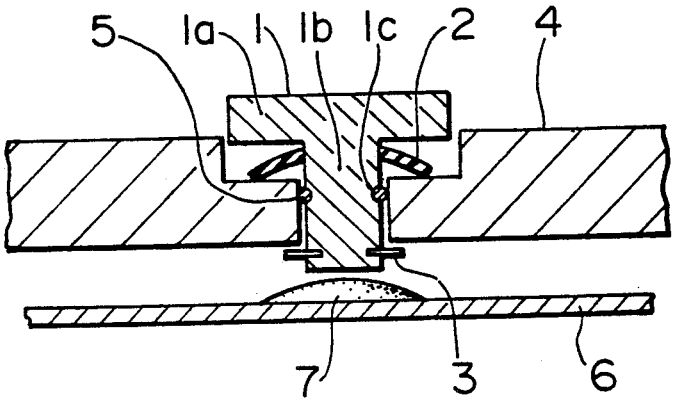
FIG. 4 PRIOR ART
FIG. 4 is an elevational sectional view showing a structure of a conventional waterproof switch for an electronic device.
Figure 2:
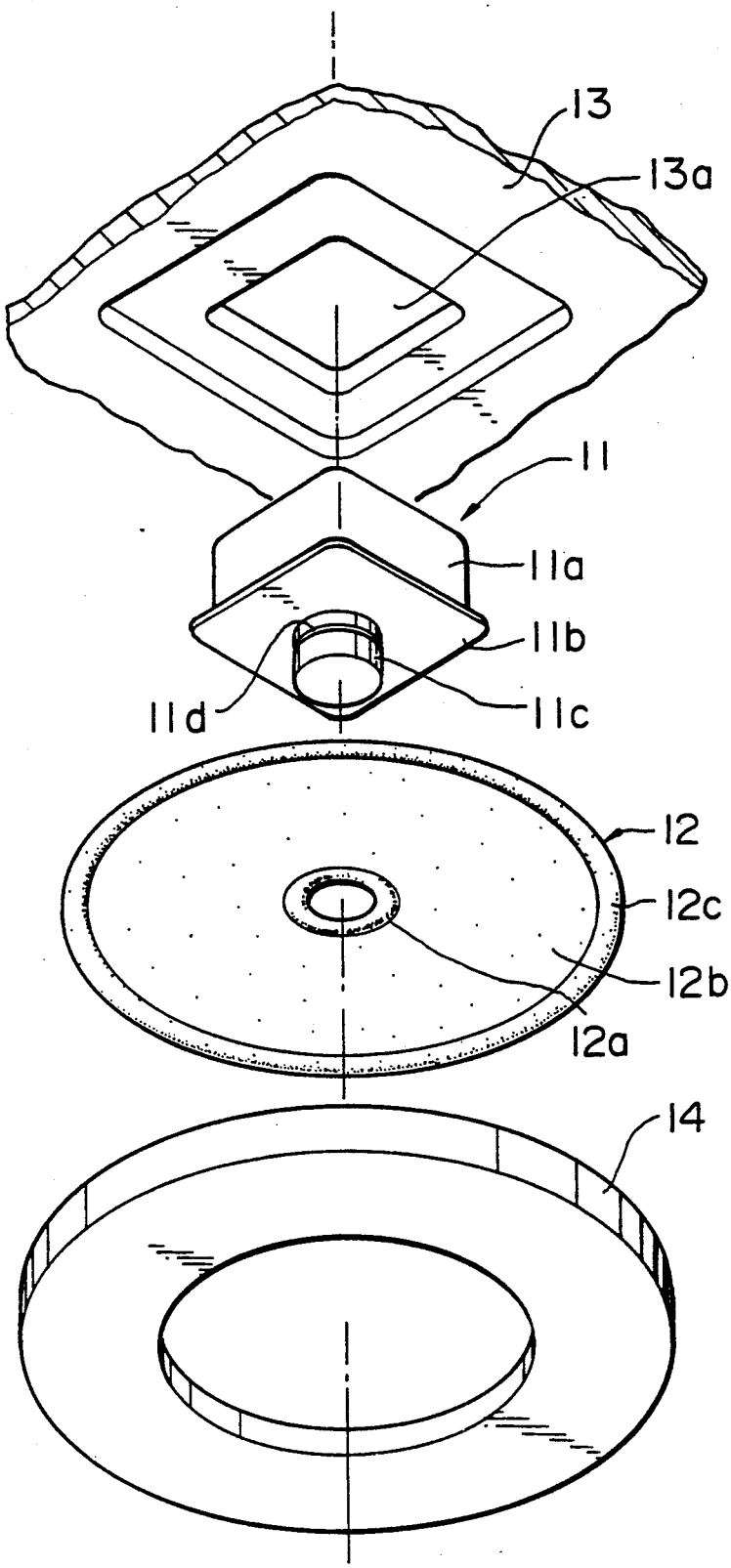
FIG. 2 is a decomposed perspective view of a waterproof switch apparatus for an electronic device according to a first embodiment of the present invention.

In FIGS. 1 and 2, numeral 11 denotes a push-button, which comprises a head portion 11*a*, a flange portion 11*b*, and a shaft portion 11*c* formed with an annular groove 11*d* extending in a circumferential direction, these portions being arranged successively in a downward direction. Numeral 12 denotes an elastic flat sealing member made of, for example, a rubber, which comprises an inner peripheral portion 12*a* press-fitted into the groove 11*d* of the push-button 11, a thin portion 12*b* and an outer peripheral portion 12*c*. Numeral 13 denotes a device body, which is formed with a push-button hole 13*a* for passing outwardly the head portion 11*a* of the push-button 11 with the flange portion 11*b* remaining inside of the device body 13. Numeral 14 denotes a holding member, which is fixed to the inside surface of the device body 13 and holds the outer peripheral portion 12*c* of the sealing member 12 against the device body 13. Numeral 15 denotes a printed circuit board, and numeral 16 denotes a diaphragm arranged on the printed circuit board 15 at a position opposite to the tip of the shaft portion 11*c* of the push-button.

The function of the above-mentioned first embodiment will be described below. In FIG. 1, when the head portion 11*a* of the push-button 11 is pressed down, the thin portion 12*b* of the sealing member 12 is flexed downward and the tip of the shaft portion 11*c* presses the diaphragm 16, thereby closing a contact mounted on the printed circuit board 15. When the pressing force on the push-button 11 is released, the push-button 11 is returned upward to its original position by the help of an elastic restoring force of the thin portion 12*b* of the sealing member 12 and the diaphragm 16 is also returned to its original position, thereby opening the contact on the printed circuit board 15.

Since the sealing member 12 acts to provide a sealing function between the push-button 11 and the device body 13, any water is prevented from intruding into the inside of the device body, even when the push-button 11 moves upward or downward.

As mentioned above, according to the above-mentioned embodiment, an elastic flat sealing member 12 is arranged between the push-button 11 and the device body 13, and the sealing member 12 also serves as a restoring spring acting on the push-button 11, thereby requiring no special space for a return spring. As a result, a switch having a thinner thickness as a whole can be obtained.

Since the inner peripheral portion 12*a* of the sealing member 12 is in close contact with the groove 11*d* of the shaft portion 11*c* of the push-button 11, and the outer peripheral portion 12c is put closely between the device body 13 and the holding ring 14, there is obtained an advantage that an intrusion of water into the inside of the device body can be prevented.

Although, in the first embodiment, the sealing member 12 and the holding member 14 both have circular shapes, they are allowed to have other shapes. Further, although the head portion 11a of the push-button 11 has a rectangular shape, the shape is not restricted to be rectangular.

Figure 3:
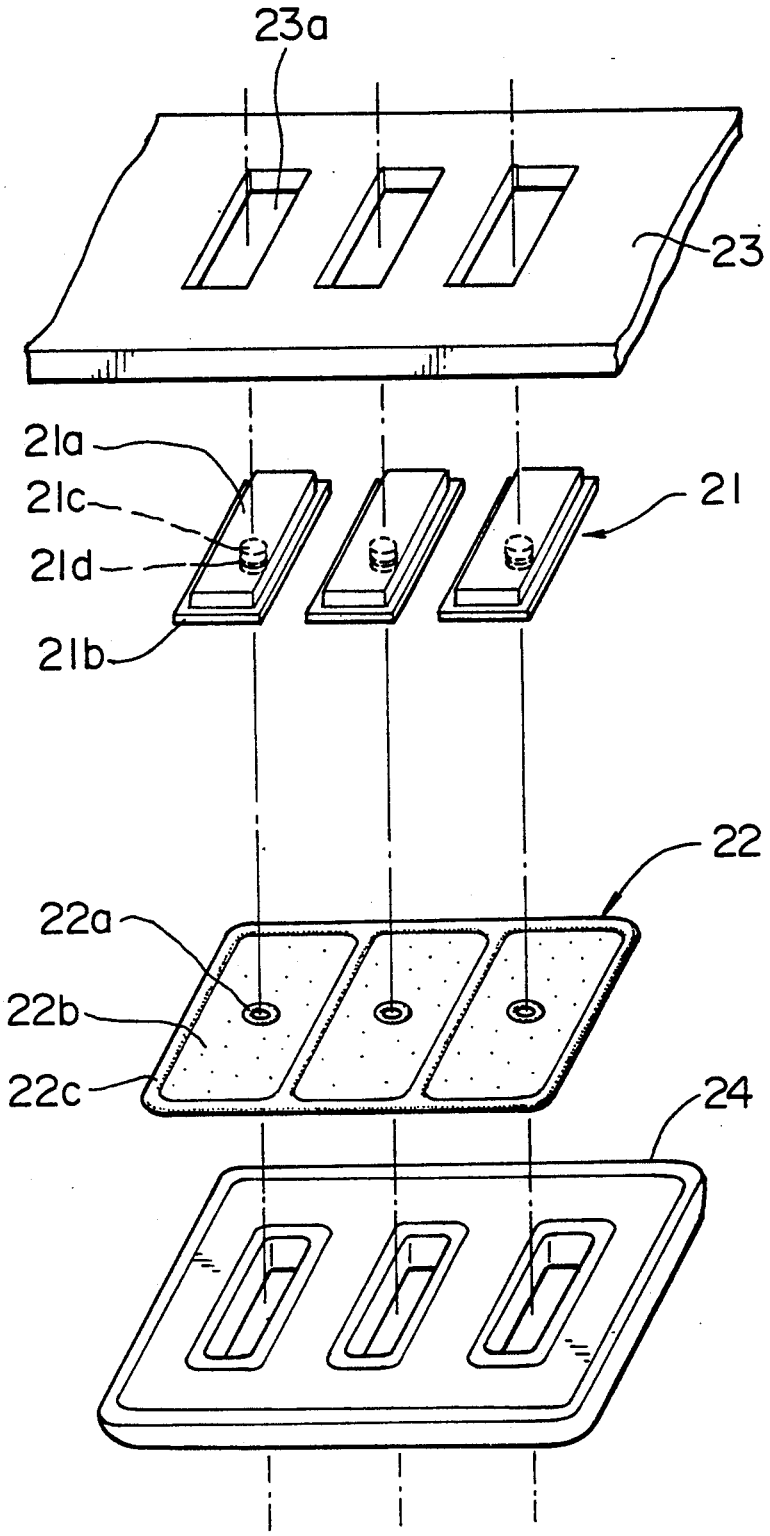
FIG. 3 is a decomposed perspective view of a waterproof switch apparatus for an electronic device according to a second embodiment of the present invention.

FIG. 3 shows a structure of a second embodiment of the present invention. In FIG. 3, numeral 21 denotes three push-buttons, each of which comprises a head portion 21a, a flange portion 21b and a shaft portion 21c formed with a circumferential groove 21d. Numeral 22 denotes an elastic flat water sealing member capable of sealing the three push-buttons together, each sealing portion of which comprises an inner peripheral portion 22a to be fitted into the groove 21d of the shaft portion 21c of the push-button 21, a thin portion 22b and an outer peripheral portion 22c. Numeral 23 denotes a device body, which is formed with three push button holes 23a for passing the head portions 21a of the push-buttons 21 with the flange portions 21b remained in the inside of the device body 23. Numeral 24 denotes a holding member disposed on the inside surface of the device body 23 for holding the outer peripheral portion 22c of the sealing member 22 against the device body 23.

Since, in the above-mentioned second embodiment, similarly to the first embodiment, the water sealing member functions both as a water sealing means and as a return means, there is obtained an advantage that the switch can be made thin, and the number of parts of the switch can be decreased by virtue of the multi-connected structure of the switch.

As is clear from the above-mentioned embodiments, the present invention has various advantages that the switch as a whole can be made thin, because the water sealing member additionally has a spring function for returning the push-button to its original position and no special return spring is required; an intrusion of water into the device body can be prevented, because the sealing member is made in close contact with the shaft portion of the push-button and with the device body; and the life of the switch can be made longer, because the elastic sealing member made of such as rubber has a return force stronger than that of a return plate spring which is frequently used in prior arts.

What is claimed is:

1. A waterproof switch apparatus for an electronic device, comprising:

a body having at least one through-hole formed therein;

at least one push-button, disposed in said through-hole, having a head portion and a shaft portion, said head portion having a flange portion for preventing said push-button from coming out of said through-hole, said shaft portion having an annular groove, a tip of said shaft portion being adapted to open and close a switch contact when said push-button is actuated;

a water sealing member made of an elastic material, said water sealing member having an inner peripheral portion fitted in said annular groove of said shaft portion of said push-button in close contact therewith and an outer peripheral portion; and a holding member, operatively associated with said body, for holding said outer peripheral portion of said water sealing member by pressing said outer portion against said body.

2. A waterproof switch apparatus for an electronic device claimed in claim 1, wherein said waterproof switch apparatus comprises a plurality of switches arranged in line and a plurality of push-buttons arranged in isolation, and said water sealing member and said holding member are adapted to seal said plurality of push-buttons and to hold said sealing member, respectively.

3. A waterproof switch apparatus for an electronic device claimed in claim 1, wherein said outer peripheral portion of said sealing member has a ring shape.

4. A waterproof switch apparatus for an electronic device claimed in claim 1, wherein said outer peripheral portion of said sealing member has a rectangular shape.

5. A waterproof switch apparatus for an electronic device claimed in claim 1, wherein the switch contact is opened and closed by the tip of said shaft portion of the push-button via a diaphragm.

6. A waterproof switch apparatus for an electronic device claimed in claim 5, wherein said switch contact is mounted on a printed circuit board of said electronic device.

7. A waterproof switch apparatus for an electronic device claimed in claim 1, wherein a portion of said water sealing member has a substantially flat shape.

8. A waterproof switch apparatus for an electronic device claimed in claim 1, wherein said water sealing member comprises means for applying an elastic restoring force to said shaft portion of said push-button to return said push-button to an original rest position after said push-button has been actuated.

* * * * *